US006140778A

United States Patent [19]

Pringle et al.

[11] Patent Number: 6,140,778

[45] Date of Patent: Oct. 31, 2000

[54] LOW PRESSURE XENON LAMP AND DRIVER CIRCUITRY FOR USE IN THEATRICAL PRODUCTIONS AND THE LIKE

[75] Inventors: David A. Pringle, 16749 Bollinger Dr., Pacific Palisades, Calif. 90272; David McDonald, Canyon Country, Calif.; Zhong Fang Yan, Shangai, China; George Johnson, Hollywood, Calif.

[73] Assignee: David A. Pringle, Hollywood, Calif.

[21] Appl. No.: 08/466,101

[22] Filed: Jun. 6, 1995

Related U.S. Application Data

[62] Division of application No. 08/157,119, filed as application No. PCT/US92/04656, Jun. 4, 1992.

[51] Int. Cl.[7] ..... H05B 37/00

[52] U.S. Cl. ..... 315/289; 315/290; 315/200 A; 315/194; 315/209

[58] Field of Search ..... 315/289, 200 A, 315/290, 194, DIG. 4

[56] References Cited

U.S. PATENT DOCUMENTS

| | | | |
|---|---|---|---|
| 3,488,558 | 1/1970 | Grafton . | |
| 3,497,768 | 2/1970 | Mathisen | 315/183 |
| 3,870,924 | 3/1975 | Helmuth . | |
| 3,886,405 | 5/1975 | Kubo . | |
| 4,041,351 | 8/1977 | Whitehouse et al. | 315/205 |
| 4,095,139 | 6/1978 | Symonds et al. . | |
| 4,095,140 | 6/1978 | Kirkhuff et al. | 315/199 |
| 4,149,113 | 4/1979 | Sammis . | |
| 4,477,796 | 10/1984 | Kearsley . | |
| 4,687,985 | 8/1987 | Pitel | 323/323 |
| 4,697,122 | 9/1987 | Hoffer | 315/158 |
| 4,751,433 | 6/1988 | Baccanelli | 315/194 |
| 4,882,520 | 11/1989 | Tsunekawa et al. . | |
| 5,150,012 | 9/1992 | Pringle et al. | 315/200 A |

FOREIGN PATENT DOCUMENTS 2 655 436 12/1989 France .

*Primary Examiner*—Frank G. Font
*Assistant Examiner*—Reginald A. Ratliff
*Attorney, Agent, or Firm*—Ladas & Parry

[57] ABSTRACT

Disclosed is a lower pressure xenon lamp (12) and the driver circuitry therefor for producing relatively short bursts of intense light from the lamp (12). The lamp (12), including its associated driver circuitry (50) can be used in theatrical, stage, movie and/or video production to simulate, among other things, bursts of lighting. The lamp (12) is installed in a fixture together with a power supply (20) and a control system (50) is provided for controlling when the lamp (12) is turned on and off. Preferably, the control system (50) includes manually operated switches (53, 57, 54) and preferably one or more controllers (50) can be coupled together in a series fashion, should it be desired to control the lamp (12) for a greater number of time cycles then permitted by a single controller (50). Alternative power supplies (20) are disclosed. One power supply (20) permits the intensity of the flashes of light (12) to be controlled.

21 Claims, 6 Drawing Sheets

A1
P1-3
Q1
P1-4
A2
P1-1
Q2
P1-2
100 OHM
1/2 WATT
R4
R5
R12
R13
10 KOHM
C7
C8
0.003 MFD
1 KVDC
U2
U3
4N40
DS2
RED
R3
100 OHM
1/2 WATT
K1-A
110
111
AUX.
RELAY
CONTACTS
COM.
N.C.
N.O.
K1-B
C2
100 MFD
15 VDC
101
U1A
R10
10 KOHM
R17
47 KOHM
C3
0.1 MFD
50 VDC
R18
50 KOHM
CR6
1N4004
103
MC3403
U1D
R16
390 KOHM
CR2
1N4741
11 VDC
98
CR5
1N4004
104
100
102
U1B
U1C
R11
10 KOHM
R15
180 KOHM
R8
10 KOHM
R7
10 KOHM
CR3
1N4004
R6
1 KOHM
CR4
1N4004
DS1
GREEN
R14
18 KOHM
C4
0.01 MFD
50 VDC
R2
47 KOHM
1/2 WATT
R9
10 KOHM
E+
95
E-
9Z
MDA920A7
CR1
K
96
REMOTE
LEVEL SET
(0V-FULL OFF)
(3.5V-FULL ON)
P1-6
C5 0.1 MFD
C6 0.1 MFD
P1-5
12VAC
S+
S-
PUSH FOR
"LIGHTNING"
S1
10
22
23
Q1
29
C1
28
Q2
24
R1
A2
Q2
A1
Q1
TR1
240:12
26
12 VAC
12 VAC
14

LOW PRESSURE XENON LAMP AND DRIVER CIRCUITRY FOR USE IN THEATRICAL PRODUCTIONS AND THE LIKE

This is a divisional of application Ser. No. 08/157,119 filed Mar. 22, 1994 which is a national stage application of PCT/US92/04656 filed Jun. 4, 1992.

TECHNICAL FIELD

The present invention provides a lamp and associated driver circuitry which is programmable for the purpose of producing precisely controlled, short bursts of light for use in theatrical productions, on stage, in video productions and the like. The light produced can be intense and bright like a flash of nearby lightning or the flash can be of lower intensity like a flash of lightening off in the distance. The bursts are of a relatively short duration, and multiple bursts can be generated. Therefore, the lamp and associated driver circuits can be effectively used to simulate a bolt of lightning or a number of bolts of lightning, of varying intensity.

BACKGROUND

In theatrical, stage, and video productions, relatively short bursts of white light are sometimes used to mimic bolts of lightning, artillery fire and the like. In the prior art, bright flashes of light was produced by a manually operated scissors switch wherein a DC current was drawn between carbon electrodes and the switch was manually operated so as to draw and extinguish the arc in a manner more or less mimicking bolts of lightning.

This prior art technique suffers from a number of drawbacks. First, there is the obvious safety question of using a person to manually draw an arc using a scissors switch between two electrodes. Second, even when the scissors switch can be used sagely, its use takes a toll on the DC generators used to produce the power to draw the arc, since the DC generator is essentialloy short circuited when the arc is drawn. Third, since the scissors switch is manually operated, the mimicked lightning bolts were not replaceable. Thus, for stage or theatrical productions, the lightning bolts would be repeatable from performance to performance, and therefore they could not be easily timed to music or other events occurring during the performance. For movie or video work, when the same scene goes through a number of takes, each of the takes would have a different lightning display, thereby making it more difficult to edit the movie or video with scenes from difference takes. There is no practicable way of varying the intensity of the flashes of light in the prior art to mimic, for example, intense nearby flashes of lightning and more distance flashes.

The present invention overcomes these difficulties by providing a lamp and driver circuitry for use therewith which can produce short, intense bursts of light or lower intensity bursts (if desired), such as what might be used to mimic bolts of lighting, in a manner which is safe, easily programmable and repeatably, and, morevoer, does not require a DC generator and therefore does not adversely impact a DC generator. The lamp has an internal impediance so circuit is limited by the impediance.

BRIEF DESCRIPTION OF THE INVENTION

In one aspect the present invention provides a high tensity, intermittently operated lamp for use in theatrical, stage, movie and video productions. The lamp comprises an elongated tube having electrodes disposed at the ends thereof, which tube is filled with xenon gas at a pressure less than atmospheric pressure. The lamp produces on the order of 40 to 70 lumens per watt when its electrodes are energized.

In another aspect of the present invention provides a high intensity lighting system for use in producing relatively short bursts of intense light. The system includes a lamp containing xenon gas at a pressure less than atmospheric when cold, an ignitor, and a switching circuit connected in series with the lamp and the ignitor. The circuit couples the lamp and the ignitor to a source of electrical power in response to a control signal. A control circuit generates the control signal, the control circuit including manually operated switches for controlling when the control signal is turned on and turned off. The control circuit also includes a safety circuit for limiting the on time period of the control signal to a predetermined maximum time period.

In another aspect the present invention provides a high intensity lighting system for use in producing relatively short bursts of light, wherein the system includes a lamp, a power supply coupled to the lamp and responsive to a control signal for applying electrical power to the lamp, and a control circuit for generating the control signal. The control circuit includes a counter for counting through a predetermined number of states and multiplexer means responsive to said counter and to the state of selected switches so that the control signal is generated for each state of the counter when its associated switch is in a predetermined state.

In yet another aspect the present invention provides a high intensity lighting system for use in producing relatively short bursts of light, the lighting system including a lamp containing xenon gas and a power supply coupled to said lamp for igniting the lamp in response to a control signal. A control circuit is disposed in a housing located remotely from the lamp, but operationally connected thereto, for providing the control signal to the power supply. The control circuit includes manually operated switches for controlling the control signal is turned on and off, the housing including connectors for coupling the control signal via a cable to the power supply and further including additional connectors for connecting the control circuit to yet another control circuit in a separate housing thereby increasing the number of manually operated switches available for controlling when the control signal is turned on and off.

DETAILED DESCRIPTION

Figure 1:
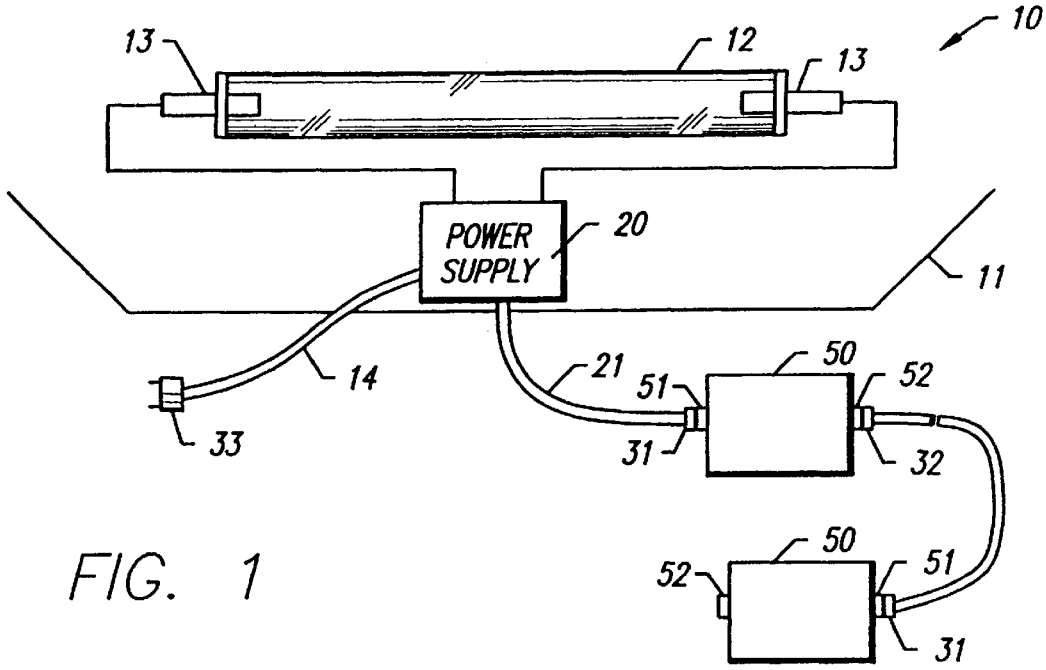
FIG. 1 is a schematic representation of the lamp of the present invention installed in a fixture and this figure also depicts box diagrams of the circuits used to drive the lamp.

FIG. 1 is a schematic representation of the lamp 10 used in the present invention, as well as depicts, using box diagrams, the power switch and the ignitor 20 which powers the lamp and a controller 50 which controls the power switch 20. As will be described, multiple controllers 50 may be used in the preferred embodiment.

The lamp is typically mounted in a lamp head or other suitable fixture 11. Since such fixtures are well known in the prior art and since means for mounting lamps in fixtures are well known in the prior art, those details, which are a matter of design choice, are not described herein. The lamp itself and the power switch and controllers which control it, are unique, and therefore are described in detail.

The lamp 10 comprises an elongated glass tube 12, preferably quartz glass, which is sealed at its ends about electrodes 13 which are preferably made of tungsten. The overall length of the lamp, including its electrodes, is typically on the order of 660 mm while the inter-electrode spacing between the two electrodes is on the order of 500 mm. Thus, the arc drawn in the lamp is rather long. The lamp is filled with xenon gas at a pressure of 0.2 to 0.3 atmospheres at ambient temperature. This lamp can be energized with 22- volts AC current and it will then draw 200 to 300 amps and produce approximately 40 to 70 lumens per watt with a Color Rendition Index of 94–96. The lamp has a diameter of approximately 25 mm, and thus has a cross sectional are of approximately 490 $mm^2$. Therefore the ratio of the cross-section area, in square millimeters, to the current carrying capability of the lamp, in Amps, when energized at 220 volts AC, is approximately 490:200 to 490:300. When hot, the xenon pressure will increase, but stay below one atmosphere.

Figure 2:
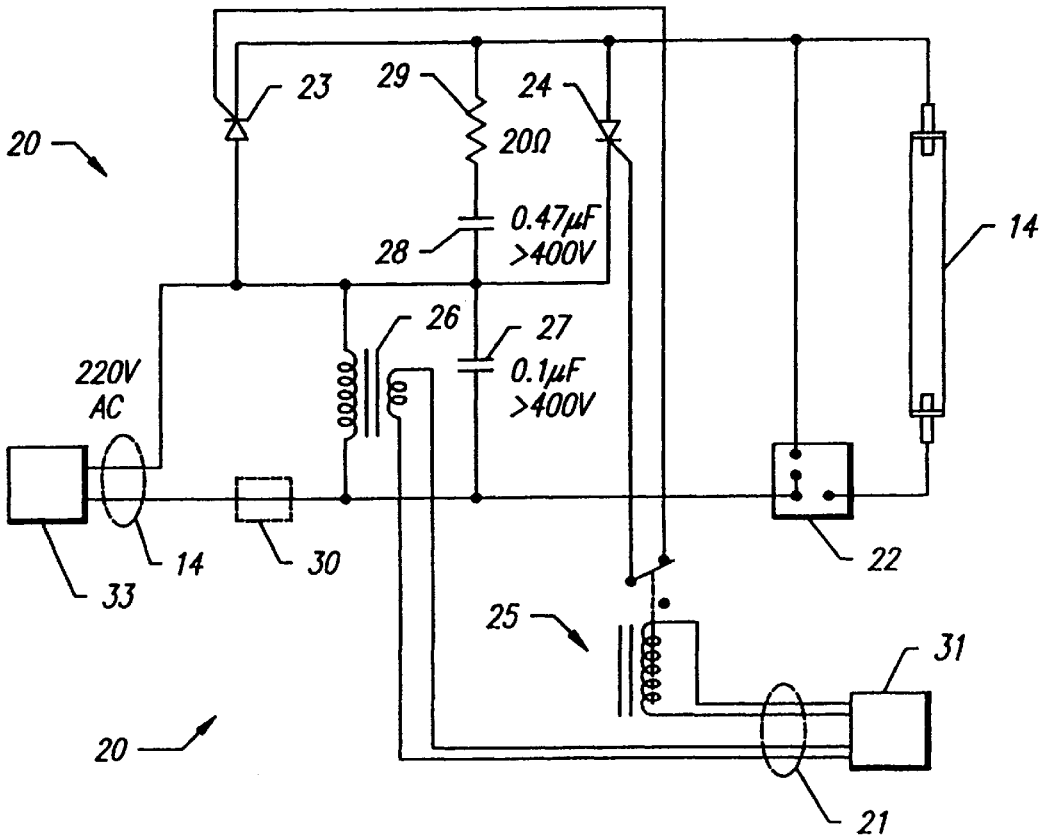
FIG. 2 is a schematic diagram of a first embodiment of the power switch used to drive the lamp.
Figure 6:
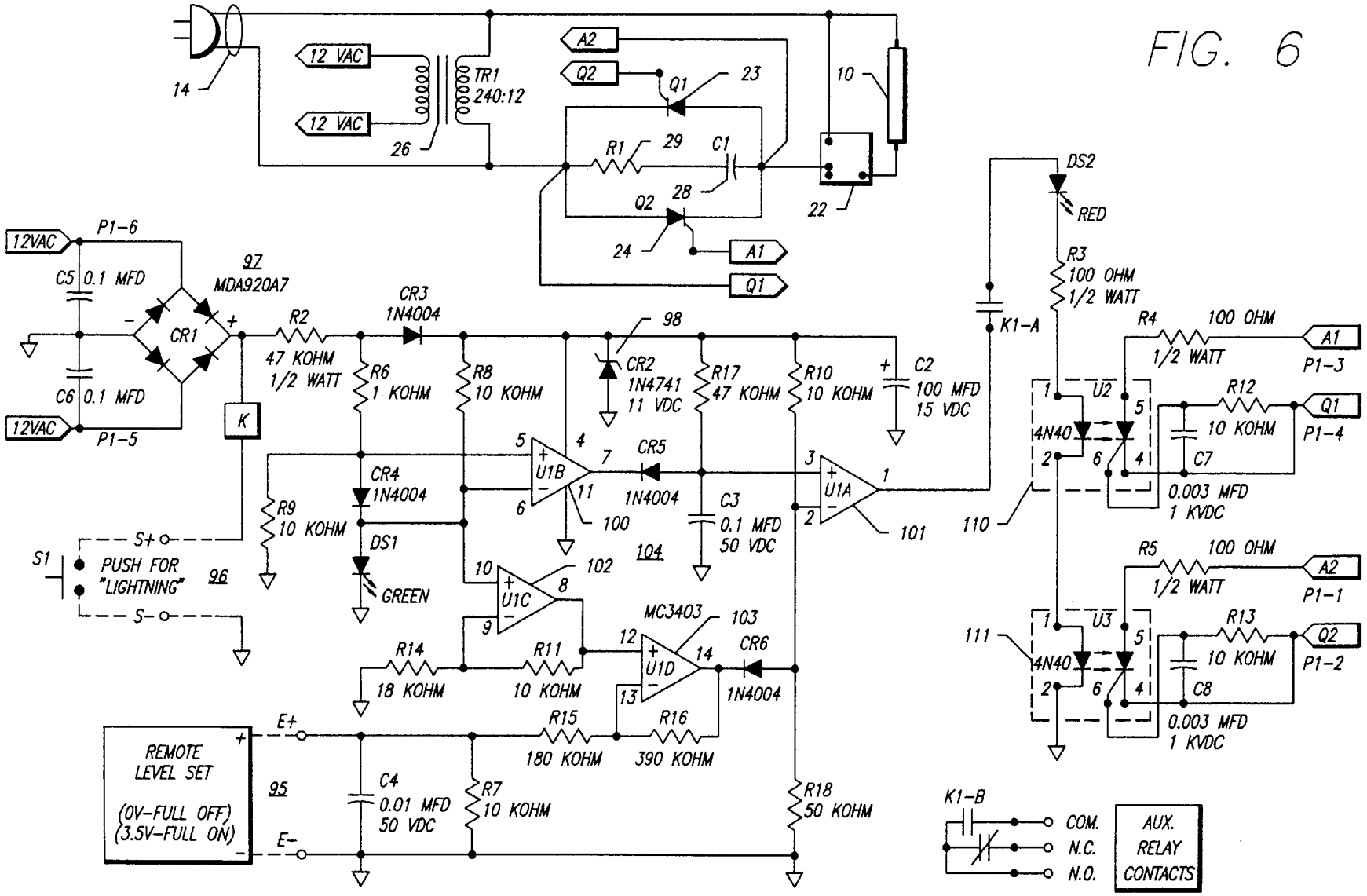
FIG. 6 is a schematic diagram of a second embodiment of the power switch, which switch permits the intensity of the bursts of light to be varied.

The power supply and ignitor 20 will be described in greater detail with reference to FIGS. 2 and 6. The power supply of FIG. 2 is capable of driving the lamp 10 to produce short flashes of high intensity light. The power supply of FIG. 6 is responsive to an intensity control signal and varies the intensity of the light produced by lamp 10 in response to the intensity control signal. The power supply of FIG. 6 will be described in greater detail later in this patent. The power supply of FIG. 2 receives 220 volt AC power, typically via a cable 14 and a conventional connector 33. The power switch and ignitor 20 conveys 12 volt AC power to and receives control signals from one or more controllers 50 via cable 21 which has a connector 31 disposed at the end thereof. Connector 31 mates with a connector 51 on controller 50. The controllers can preferably be connected together in a series fashion by means of cables 33 having connectors 32 and 31 at the ends thereof. Connector 32 mates with connector 52 on controller 50 while connector 31 mates with connector 51, on those controllers which are not connected directly to the power switch and ignitor 20.

Turning to FIG. 2, FIG. 2 is a schematic diagram of the components used in power switch and ignitor 20. The power switch ignitor 20 receives 220 volt AC power via conductors in cable 10. An ignitor 22, lamp 14, and a pair of SCR switching devices 23 and 24, are connected in series with the aforementioned source of power. Ignitor 22 is commercially available from L.P. Associates, Inc., of Hollywood, Calif. 90038 under Model No. LS2. This ignitor accepts a 220 V input and outputs >50 KV pulses at a maximum, intermittent load of 400 Amps.

The SCR's should be rated for 800 volts, 470 amps and suitable SCR's for this application are available from National Electronics of Chicago, Ill. under Model NO.NLC290. These SCR's are rated at 800 volts, 470 Amps.

The gates of the two SCR's 23, 24 may be connected together by means of the contacts of a 12 volt relay 25 which is controlled by controller 50, as shown in FIG. 2, or they may be driven by an external current source as shown in FIG. 6. In the embodiment of FIG. 2, a small series resistor may be used, if desired, to limit the gate current. When the relay closes, lamp 10 is energized. Across the SCR's are preferably connected a 20 ohm resistor 29 and a 0.47 microfarad capacitor 27, 28. Across the input power supply is connected a 0.1 microfarad capacitor as well as a 220 volt to 12 volt step down transformer 26. The secondary of transformer 26 provides a 12 volt AC source of power to controllers 50 via cable 21.

A ballast and/or fast acting circuit breaker may also be connected in series with the ignitor 22, lamp 10 and SCR's 23 and 24, such as is diagrammatically depicted at numeral 30. Of course, whether or not a ballast and/or fast acting circuit breaker is used does not particularly effect the way the present circuitry operates, but rather would be added for safety and/or because of local code requirements.

Figure 3:
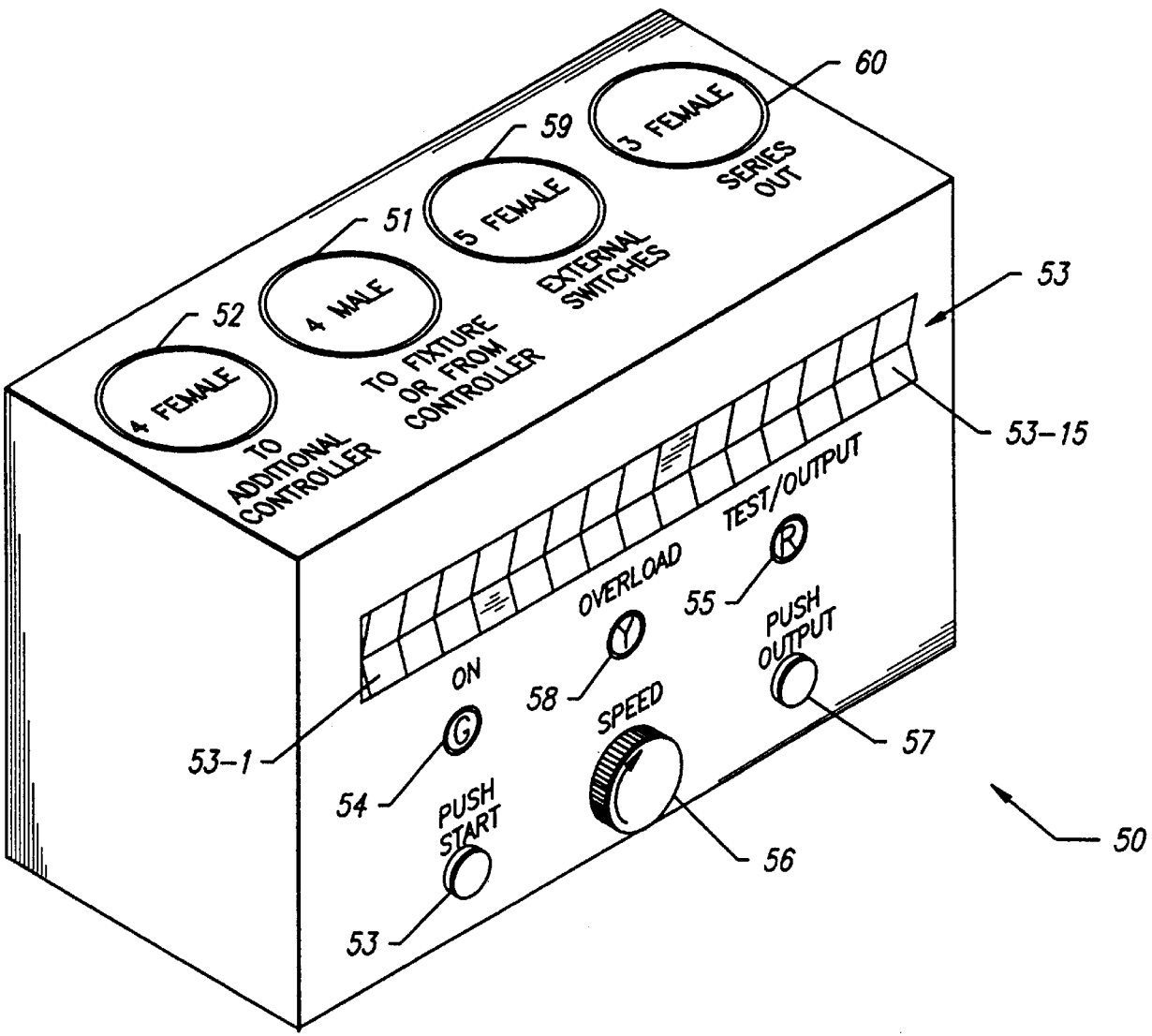
FIG. 3 is a perspective view of a housing for a control circuit used to control the power switch, this view showing the various controls, connectors and indicators which are present in the preferred embodiment of the invention.

FIG. 3 is a functional view of the various controls and connectors which would be available on the housing of controller 50. Two connectors, namely, connector 51 and connector 52, have already been described. Connector 51 may be a male connector, for example, for connecting the controller 50 either to lamp fixture 10 or from another controller 50, while connector 52 may be a female connector for connecting controller 50 to an additional controller 50.

A number of switches 53, in this case, fifteen switches, are shown on the housing. These switches are the on-off type and can be rocker switches or depression switches, as a matter of design choice.

When the start button 82 is operated, the controller starts counting in a counter IC 65 (FIG. 4) at a speed which is controlled by a timer circuit which in turn is controlled by a potentiometer 56. As the controller counts through fifteen different states, a control signal is provided to relay 25 depending upon whether or not a switch 53 associated with each time period has been turned on. Thus, the user of the controller can control the sequencing of the bursts of light from lamp 10. For example, the length of the on periods and the length of the off periods of the flashes can be controlled by appropriate positioning of switches 53 and by controlling potentiometer 56.

In operation, the switches 53 are set in some pattern and if start button 53 is depressed, then the pattern of bursts of light which the lamp 12 will ultimately produce will appear at a Light Emitting Diode (LED) 55. Thus, the pattern of switches 53 and the speed control 56 can be varied until a suitable pattern of bursts is seen at LED 55.

Output switch 57 controls whether or not the control signal generated within the controller is actually supplied to relay 25. Thus, output switch 57 permits the pattern of the bursts to be tested without causing lamp 12 to be energized. Switch 57 can either be a push or close switch, or alternatively, it can be a toggle type switch. In any event, once a suitable pattern of bursts is seen at LED 55, the pattern can be tested using lamp 10 or actually used for production purposes by closing switch 82 and thereafter closing switch 53.

As will be seen, the switches 53 and 82 need not be operated locally, but rather their circuits can be closed from a remote location by an appropriate connection made to connector 59.

As has been previously indicated, a number of controllers 50 can be connected logically in series so that after one controller counts through its fifteen states, it can cause the next controller to start counting to its fifteen states, should more than fifteen states be required for a desired pattern of bursts of light from lamp 10. To that end, connector 60 provides an output which when connected to connector 59 of a controller 50 downstream, can be used to electrically close switch 82 so as to cause the pattern of bursts controlled by at the subsequent controller 50 to be initiated. Of course, many controllers can be connected together in this fashion or in parallel for more complex patterns of light. Additionally, the last controller in the series may likewise be connected to the first controller in the series making an endless loop with a continuous and repeating output sequence. This sequence begins with the closure of any switch 82 in the series and ends after the disconnection of any 2 controllers. Also, connector 59 can be used to permit the push-start switch 82 and switch 57 to be controlled from an external source or location, if desired. For example, if it were desired to control the bursts of light to be in sync with music or other lighting effects during production of a theatrical work which is under, for example, MIDI control, then switch 53 could be effectively closed using a MIDI device by the external connection available through connector 59. Alternatively, a MIDI port could be placed on the housing itself so that the MIDI data could be applied directly to controller 50, as will be discussed with reference to FIG. 5.

Figure 4A:
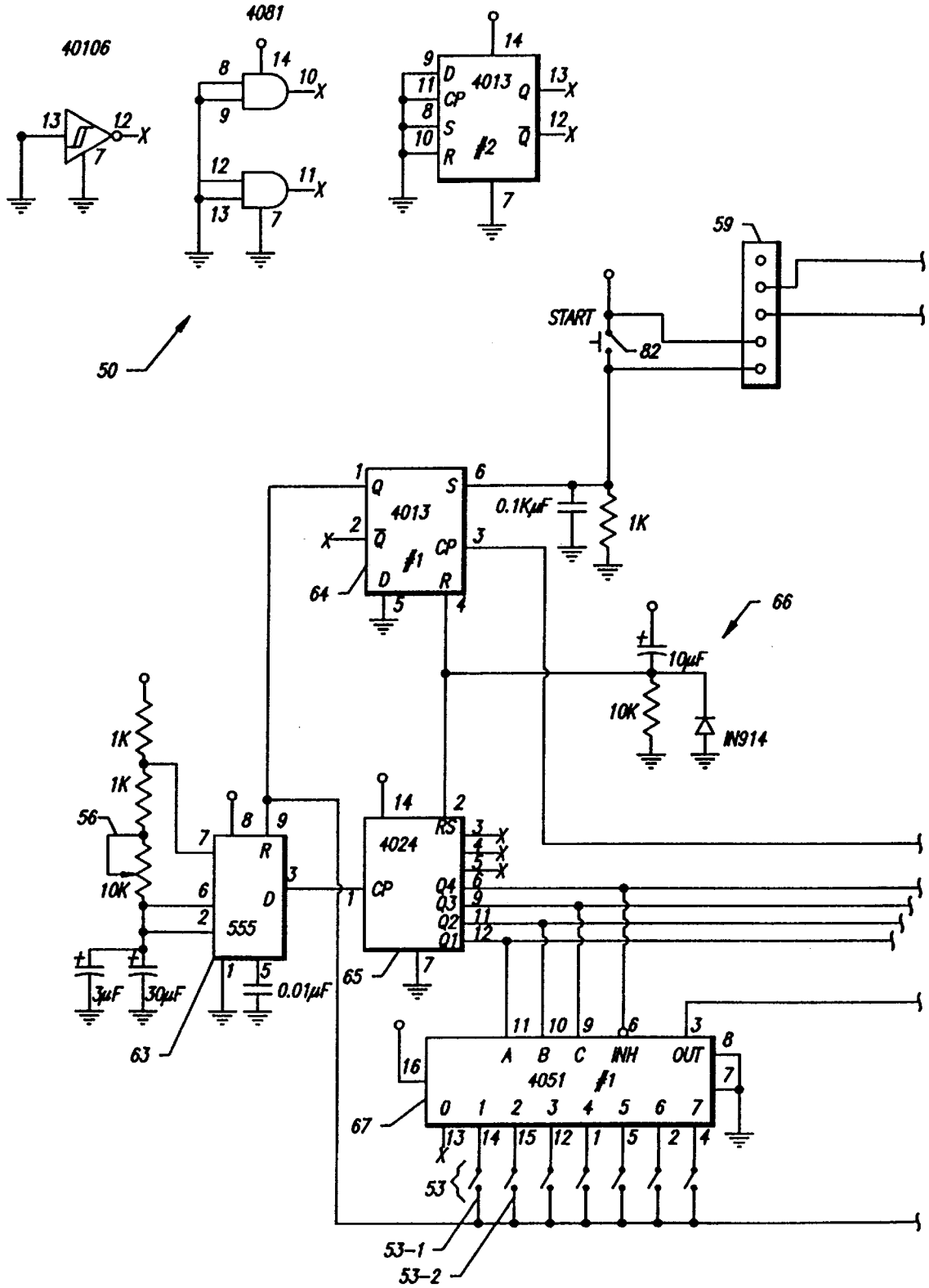
FIGS. 4A and 4B form a logic diagram of the control circuit, which logic diagram is hereafter referred to as FIG. 4.
Figure 4B:
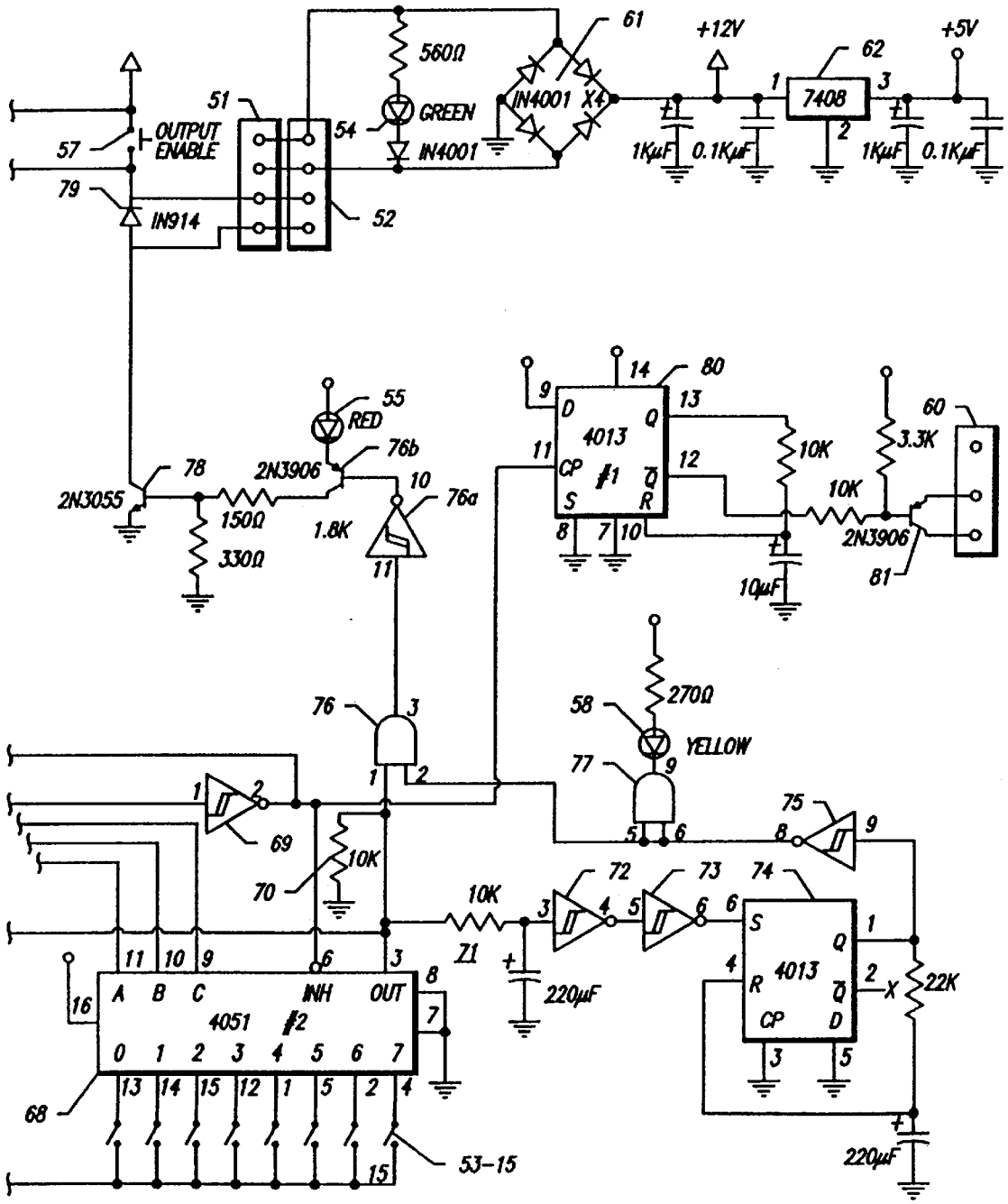

FIG. 4 is a logic diagram of controller 50. As indicated above, 12 volt AC power is applied via connector 51, the pins of which are connected to a full wave bridge rectifier 61 so as to provide a 12 volt DC source and to a regulator 62, the output of which provides a 5 volt DC source. The 5 volt DC source is used as a supply to the various IC's whereas the 12 volt DC source is used to provide the output signal to relay 25 (FIG. 2).

Potentiometer 56 controls the frequency of a timing IC 63, which is preferably provided by a type 555 IC. Timing IC 63 is reset by the Q output of flip-flop 64 which may be preferably provided by a type CD4031B IC. Flip-flop 64 is, in turn, triggered by a momentary closure of switch 82, to start counting IC 65. The output of IC 63 on pin 3 is applied to counter IC 65, which is preferably provided by a type CD2024B type IC. A power up reset circuit 66 resets both IC 64 and IC 65.

The output of counter IC 65 on pins Q1–Q4 are applied to three inputs and to an inhibit input (INH) of a pair of multiplexers IC's 67 and 68, the most significant bit of the output from IC 65 on Q4 being inverted by invertor 69 before being applied to IC 68. IC 67 and 68, when not inhibited, each select one of eight inputs (0–7) to be connected to its output (OUT). As can be seen, switches 53 are each wired in series with an input 1–7 of IC 67 or an input 0–7 of IC 68 with the Q output from flip-flop 64. The outputs of the two multiplexers IC 67, IC 68, are coupled together and coupled to ground via a resistor 70 and are also coupled via an RC timing circuit 71 to the input of a Schmidt trigger invertor 72. The output of the Schmidt trigger 72 invertor is applied via another invertor 73 to the set (S) input of a flip-flop 74. The Q output of the flip-flop 74 is applied via an invertor 75 as one input to an AND gate 76, the other input being the outputs from IC 67 and IC 68. The output of invertor 75 is also applied via an AND gate 77, which is merely used as a driver, for LED 58.

The RC circuit 71 in combination with the Schmidt trigger invertor 72 operates with a 2.2 second time period. The RC circuit 71 in combination with the flip-flop 74 and the related circuitry causes a logic level 0 to appear on pin 2 of AND gate 76, thereby turning off that AND gate should an output from either one of the multiplexers IC's, 67 or 68, exceed 2.2 seconds. This is a safety circuit to ensure that the lamp 10 will not be energized for longer than a predetermined period of time, which in this embodiment is set at 2.2 seconds. Generally speaking, the low pressure long arc xenon lamp 10 should not be energized for more than 3 seconds continuously. Whenever the output of invertor 75 gets to a logic level 0, that causes LED 58 to light, indicating that an overload condition is occurring, thereby alerting the user of the device to reprogram it using switches 53 so as to use fewer continuous on time periods or adjust timer potentiometer 56 to use shorter time periods.

The output of AND gate 76 is coupled via an invertor **76*a* and resistor to the base of a transistor 76*b* which drives LED 55 from which the user can determine the pattern of bursts of light which will occur when the switch 57 is closed. The collector of transistor 76*b* is coupled via a resistor to the base of a transistor 78 which, in turn, provides a current flow path from the 12 volt DC source via switch 57, relay 25 (FIG. 2) which is coupled via connector 51. Diode 79 protects transistor 78** from the fly back caused by the switching of current through the relay's coil in a manner well known in the art.

The closure of one or more of the switches 53 causes relay 25 to be energized whenever counter 65 counts to a count for which the associated switch is closed. There is no switch in the zero position, since that, of course, is the state which counter 65 assumes before the start button 82 is depressed. At the end of the sixteen clock cycles, the output of invertor 69 goes high and flip-flop 64 and flip-flop 80 are then reset. Flip-flop 80 is connected as a one shot so that its Q goes low for a short period of time in response to the positive going pulse outputted from invertor 69. The Q output is applied via a resistor network to the base of a transistor 81, causing that transistor 81 to go into saturation for a short period of time after counter 65 has counted through sixteen states. Those skilled in the art will appreciate the fact that when the collector and emitter of transistor 81 are connected across the start button 82 in another identical controller by suitable cabling between connector 60 of one controller and the connector 59 in the subsequent controller, that the subsequent controller is caused to immediately start counting at the conclusion of the sixteen counts in the preceding controller. Of course, the number of states through which a controller counts is a matter of design choice.

Figure 5:
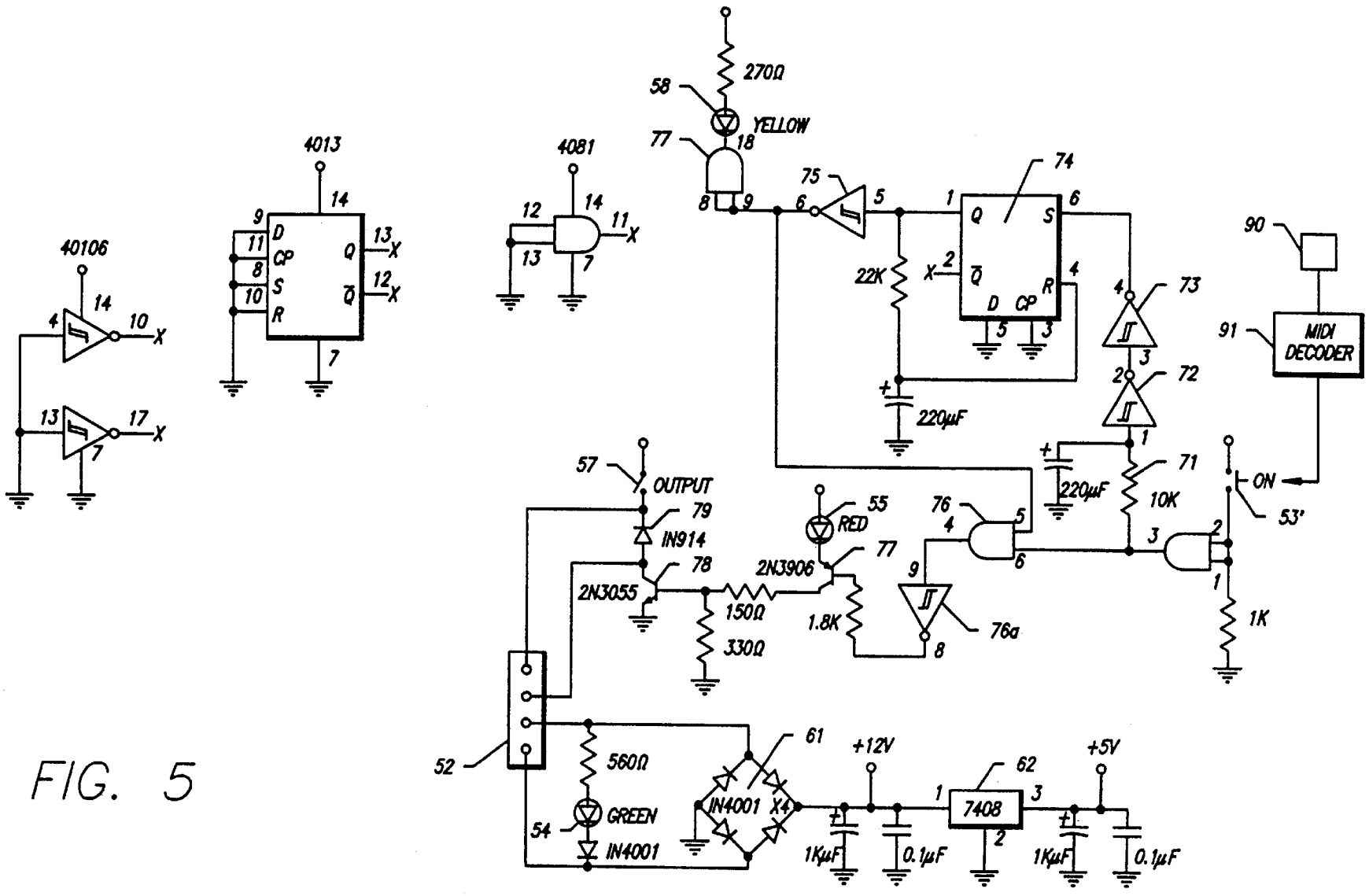
FIG. 5 is a logic diagram of a manually-operated of MIDI-operated control circuit.

FIG. 5 is a schematic diagram of a manual of a MIDI lighting controller which is rather similar to the controller of FIG. 4, but does not include the timer, counter or multiplexer IC's. Instead, the pattern of bursts of light is controlled either manually or depression of a switch 53' or by electrically closing those contacts is response to a MIDI signal, for example, received at a connector 90 on the housing of the controller, and coupled to a MIDI decoder 91. Since the operation of the circuitry of FIG. 5 otherwise closely parallels the operation of the circuitry of FIG. 4 and since the same reference numerals have been used with reference to the components which perform the same functions as FIG. 4 and in FIG. 5, further description of this logic diagram should be unnecessary for those skilled in the art.

The lamp, power supply and controllers described above are effective for producing short-duration high-intensity bursts of light, either in a programmed sequence or manually, as desired. The duration of the flashes can be controlled, but the intensity of the flashes are more or less predetermined based upon the capabilities of the lamp and its power supply. The power supply of FIG. 6 is responsive to an intensity control signal at output 95 for controlling the turn on times of SCR's 23 and 24. Components which are similar to the components in the first embodiment of the power supply (FIG. 2), bear the same reference numbers. Instead of coupling the gates of the SCR's together, as was done in the embodiment of FIG. 2, the gates of the SCR's are energized (so as to turn on the associated SCR) at a selected point during each half cycle of the 60 Hz (or 50 Hz if used) power available on lines 14. The SCR turn on point is at the beginning of each half cycle if a maximum intensity burst of light is desired, or at a later point in the half cycle if a lower intensity burst of light is desires. As is well known, the particular SCR powering lamp 10 during each half cycle turns off when it becomes reverse biased at the end of the half cycle during which it was forwarded biased and powering lamp 10.

The SCR's 23 and 24 in FIG. 6 are driven by opto-isolators 110 and 111. The opto-isolators electrically isolate the gate control portion 104 of the power supply, which include, inter alia, op-amps 100, 101, 102 and 103 (which operate on only a 11 volt DC power supply formed by diode bridge 97, zener diode 98 and capacitor C2) from the SCR's (which operate with the higher 220 volt AC voltage on lines 14). Although electrically isolated, the gate control portion of the power supply is effective for controlling the turn on times of the SCR's during each half cycle that a SCR is forward biased in response to the intensity control signal applied at input 95.

The power supply of FIG. 6 is controlled by an intensity control signal at input 95 and also by a on-off connected at 96. The pattern of burst of light from lamp 10 can be controlled by closing the switch contacts at 96 and varying the voltage at input 95 between 0 volts (lamp 10 off) to 3.5 volts (lamp 10 at high intensity). Alternatively a voltage can be selected depending on the intensity of light desired, which voltage is applied at input 95 and then the switch connected at contacts 96 can be opened and closed to yield a desired sequence of bursts of light at lamp 10. Of course, those skilled in the art will now appreciated that lamp 10 can also be controlled by combining the opening and closing of the switch at contacts 96 with a varying voltage at input 95. Closing the circuit at contacts 96 energizes relay 99, closing contact K1-A at the output of op-amp 101, thereby permitting the gate control circuitry 104 to take control of the turn on times of the SCR's 23 and 24.

The switch connected at contacts 96 can be a mechanical switch, if manual control is used to open and close the switch, or alternatively the switch can be an electronic switch, if programmed control is desired to control the opening and closing a circuit across contacts 96.

The controller of FIG. 4 requires modification before it is used with the power supply of FIG. 6, for example, the controller is to control the opening and closing of a circuit across contacts 96 and/or the voltage to be applied to input 95. Of course, it would be relatively straightforward to modify the output circuitry comprising elements 76*a*, 76*b*, 78, and 79 to merely open and close an electronic switch bridging contacts 96. Varying voltages can be applied at input 95 by using potentiometers (coupled across a 3.5 volt DC source of power, for example) or other voltage dividers, which potentiometers or dividers are sequentially coupled to input 95 using appropriate transistors to couple the same into and out of circuit connection to input 95. The control electrodes of such transistors can be connected to be responsive to octal decoders, for example, which in turn would be responsive to the binary value output from counter IC 65, for example, in a relatively straightforward manner. In that way only one potentiometer or other voltage divider is in the circuit during a given count of the counter. Of course, the number of potentiometers should equal the number of states of the counter IC 65, and in the case of the embodiment of FIG. 4, that would yield fifteen states and thus fifteen potentiometers (or other voltage dividers).

The op-amps 100–103 may be provided by a quad op-amp IC type MC3483. Op-amp 100 has one input (pin 6) connected to the 11 volt power supply through a resistor R8 and its other input (pin 5) connected to a source of pulsating DC available at the output of diode bridge 97 through a resistor R6. Op-amp 100 acts as a zero-crossing detector of the AC power on lines 14. The output of op-amp 100 pulses negative at each zero crossing, thereby discharging capacitor C3. After being discharged, capacitor C3 charges through resistor R17, i.e., as a conventional RC circuit, so that a voltage ramp is applied to a non-inverting input (pin 3) of op-amp 101, which ramp is synchronized to the AC power line so that it restarts with every zero crossing.

Op-amp 102 has one output coupled to pin 6 of op-amp 100 and its other input at pin 9 is coupled to ground via a resistor R14. This op-amp is used to scale a SC reference voltage, provided by the voltage drop across light emitting diode (LED) DS1, to provide an offset voltage at its output, which offset voltage is applied to co-amp 103 at pin 12 thereof. A resistor R11 is couples the output of op-amp 102 to its input at pin 9 as a feedback path commonly used with op-amps. The other input of op-amp 103 is connected at pin 13 via a registor R15 to input 95. Op-amp 103 is configures as an inverting voltage amplifier, offset by the previously mentioned offset voltage, and it ascertains the level of the DC intensity control signal present at input 95. The output of op-amp 103 is connected via a feedback path containing resistor R16 to pin 13 and via a diode CR6 to an input of op-amp 101 at pin 2 thereof.

Op-amp 101 thus has the previously mentioned voltage ramp, which starts over at each zero-crossing of the AC power, applied to its non-inverting input and a settable DC voltage (controlled by the intensity control signal voltage at input 95) applied to its inverting input (pin 2). Thus, op-amp 101 determines the amount of delay time (if any) after a zero-crossing occurs before the then forward-biased SCR is fired. To this end, the output of op-amp 101 is connected via normally open contacts K1-A of relay K1 and via a light emitting diode DS2 and via a restrictor R3 to series connected opto-isolators 110 and 111 and thence to ground. In this way, the level of the intensity control signal at input 95 controls when during each half-cycle of the AC power on lines 18 that the SCR's alternatingly fire (one SCR fires during each half-cycle that the lamp 10 is to be energized, the SCR firing being the SCR which is then forward biased by the AC on lines 14). If the SCR's fire at or close to a zero-crossing, the light is intense. If they fire later, the light is less intense.

The disclosed lamp, power supplies and controlled, are useful in producing short duration bursts of light which can be conveniently used in the production of movies, theater, video, and the like. The intensity of the burst of light can be varied or held constant. The length of the bursts of light can also be varied or held constant, as desired. The bursts of light can be manually controlled or preprogrammed, as desired.

Having described the invention with respect to certain preferred embodiments thereof, modification may now suggest itself to those skilled in the art. The invention is therefore not to be limited to the disclosed embodiments, except as required by the appended claims.

What is claimed is:

1. A high intensity, intermittently operated lamp for use in theatrical, stage, movie and/or video productions, said lamp comprising an elongated tube having non-heated electrodes disposed at the ends thereof, said tube containing at least xenon gas at a pressure less than atmospheric pressure, said electrodes being coupled to an AC power source whereby AC passes between said electrodes for a plurality of consecutive cycles thereof, said AC power source including an ignitor and a pair of SCRs wired in series with said electrodes and with a source of AC power, said SCRs being coupled such that the cathode of one SCR is wired to the anode of another SCR, and a circuit for driving the gates of said SCRs to deliver AC power to the lamp.

2. The lamp of claim 1, wherein said tube is a Quartz glass tube, on the order of one-half meter in length.

3. The lamp of claim 1, wherein, in use, lamp draws a current of 200 or more amps when it's electrodes are energized at 220 volts.

4. A high intensity, intermittently operated lamp for use in theatrical, stage, movie and/or video productions, said lamp comprising an elongated tube having electrodes disposed at the ends thereof, said tube containing gas at a pressure less than atmospheric pressure, and wherein said lamp is driven by a power supply coupled to said electrodes, said power supply having no means to intentionally limit current supplied to the lamp whereby the current supplied to the lamp by the power supply is essentially limited by the lamp's internal resistance, said power supply including an ignitor and a pair of SCRs wired in series with said electrodes and with a source of AC power, said SCRs being coupled such that the cathode of one SCR is wired to the anode of another SCR, and a circuit for driving the gates of said SCRs to deliver AC power to the lamp.

5. The lamp of claim 1 wherein said lamp, in use, is powered by a power supply which includes timing control circuits for turning its current on and off for producing bursts of light and intensity control circuitry for controlling the intensity of the bursts of light produced by the lamp.

6. The lamp of claim 4, wherein said current is an alternating current.

7. The lamp of claim 6, wherein said power supply comprises an ignitor and SCRs wired in series with said electrodes and with a current source, said SCRs being coupled such that the cathode of one SCRs is wired to the anode of another SCRS, and a circuit for driving the gates of said SCRs to deliver AC power to the lamp.

8. The lamp of claim 4, wherein said elongated tube has a cross section and wherein said lamp, when operating and energized with a 220 volt AC source, draws the current, and wherein the ratio of the cross sectional are of the lamp, measured in square millimeters, to the current, measured in amps, is approximately 490:200 to 490:300.

9. The lamp of claim 4, wherein at least one of the relatively short bursts of light is sufficiently long to comprises a plurality of voltage reversals of the AC power delivered to said lamp.

10. The lamp of claim 4 wherein the circuit for driving the gates of said SCRs causes said lamp to emit relatively short bursts of lights.

11. The lamp of claim 10 wherein at least one of the relatively short bursts of light is sufficiently long to comprises a plurality of voltage reversals of the AC power delivered to said lamp.

12. The lamp of claim 1 wherein at least one of the relatively short bursts of light is sufficiently long to comprises a plurality of voltage reversals of the AC power delivered to said lamp.

13. The lamp of claim 1 wherein said elongated tube has a cross section and wherein said lamp, when energized with a 220 volt AC source, draws a current, and wherein the ratio of the cross sectional area of the lamp, measured in square millimeters, to the current, measured in amps, is approximately 490:200 to 490:300.

14. The lamp of claim 4 wherein said gas comprises xenon gas.

15. A high intensity, intermittently operated lamp comprising an elongated tube having electrodes disposed at the ends thereof, said tube containing gas at a pressure less than atmospheric pressure, an ignitor and a pair of SCRs wired in series with said electrodes and with a source of AC power, said SCRs being coupled such that the cathode of one SCRs is wired to the anode of another SCRs, and a circuit for driving the gates of said SCRs, whereby said SCRs deliver a current of at least 200 amps to said electrodes.

16. The lamp of claim 15 wherein said tube is a Quartz glass tube, on the order of one-half meter in length.

17. The lamp of claim 15 wherein the circuit for driving the gates of said SCRs causes said lamp to emit relatively short bursts of lights.

18. The lamp of claim 17 wherein at least one of the relatively short bursts of light is sufficiently long to comprises a plurality of voltage reversals of the AC power delivered to said lamp.

19. The lamp of claim 15 wherein said elongated tube has a cross section and wherein said lamp, when ignited, draws a current, and wherein the ratio of the cross sectional area of the lamp, measured in square millimeters, to the current, measured in amps, is approximately 490:200 to 490:300.

20. The lamp of claim 15 wherein said gas comprises xenon gas.

21. The lamp of claim 15 wherein said SCRs comprise a power supply and wherein said power supply includes no means to intentionally limit the current supplied to said electrodes.

* * * * *